United States Patent [19]

Stanish

[11] 3,992,872

[45] Nov. 23, 1976

[54] DISPLAY DEVICE

[75] Inventor: Robert B. Stanish, Chicago, Ill.

[73] Assignee: Poster Products, Inc., Chicago, Ill.

[22] Filed: Apr. 9, 1975

[21] Appl. No.: 566,357

Related U.S. Application Data

[62] Division of Ser. No. 411,711, Nov. 1, 1973, Pat. No. 3,890,777.

[52] U.S. Cl. ..... 58/50 R; 40/106.52; 40/130 R; 58/53; 58/125 B; 58/126 A

[51] Int. Cl.[2] ..... G04B 19/30; G04B 37/00; G04B 19/02; G04F 19/34

[58] Field of Search ..... 58/50 R, 53, 55, 88 G, 58/125 A, 126 R, 126 A, 148; 40/106.52, 106.53.

[56] References Cited

UNITED STATES PATENTS

| | | | |
|---|---|---|---|
| 2,009,209 | 7/1935 | Scantlebury | 58/50 R |
| 3,262,258 | 7/1966 | Poynter | 58/53 X |
| 3,439,492 | 4/1969 | Gravenson | 58/50 R |
| 3,798,892 | 3/1974 | Lukens | 58/126 A |
| 3,817,022 | 6/1974 | Swartz | 58/50 R |

*Primary Examiner*—E. S. Jackmon
*Attorney, Agent, or Firm*—Kirkland & Ellis

[57] ABSTRACT

A display device is provided containing a transparent or translucent panel having a display on the front or back of said panel, illuminating means mounted back of said panel to cause light to be transmitted around or through said display, and a plurality of discs mounted for rotation in front of said illuminating means to the rear of said panel and to one side of said display, said discs having radial light transmitting sections and means to cause the rotation of said discs, preferably a clock mechanism, to produce a flashing radial light.

8 Claims, 5 Drawing Figures

COPY
COES
GERE
HE

DISPLAY DEVICE

This is a division of application Ser. No. 411,711, filed Nov. 1, 1973, now U.S. Pat. No. 3,890,777.

BACKGROUND

Many different types of illuminated advertising displays have heretofore been proposed such as, for example, illuminated signs and flashing signs. It would be desirable to have an advertising display in which the display is illuminated and auxiliary means are provided to call attention to the display with the display and the auxiliary means contained in a compact unit. It would also be desirable to have an advertising device of the type described in which the display is in color and attention is directed to the display by auxiliary means in the form of a flashing light also in color. It would likewise be desirable if said auxiliary means had the dual function of serving as a clock and providing a flashing light to direct attention toward the display.

OBJECTS

One of the objects of the present invention is to provide a new and useful display unit wherein an illuminated display and a rotating, radially disposed, flashing light are placed side by side in a compact unit.

Another object of the invention is to provide an illuminated display of the type described in which the rotating flashing light is provided by a clock mechanism.

A further object of the invention is to provide a new and improved clock display comprising a plurality of rotatable discs of different colors with radial light transmitting sections or slots, said discs being driven by a synchronous clock motor and a gear train and including a first disc rotatable with the second shaft of a clock having a radial light transmitting section on an opaque background, a second disc rotatable with the hour shaft having a slot or transparent section and otherwise being colored, for example, red, and a third disc rotatable with the minute shaft having the same characteristics as the second disc except that it is a different color, for example, green or blue, the second and third discs being sufficiently thick to block out light everywhere except at locations aligned with one of the transparent sections or slots in the second or third discs so that whenever a transparent section or slot in the second or third disc is aligned with a light transmitting portion on the first disc a colored illuminated flashing hour or minute hand is presented to the viewer.

Another object of the invention is to provide a clock display of the type described in which means forming a part of or attached to the first disc is rotatable around the outer rim of the second and third discs and transmits light that appears as a dot moving as an indicator of seconds in an orbit around the outer rim of the second and third discs.

A further object of the invention is to provide a new type of clock mechanism in which indicating means for hours, minutes and seconds are illuminated in a novel manner.

Other objects and advantages of the invention will appear from the following description in conjunction with the accompanying drawings.

THE DRAWINGS

BRIEF SUMMARY OF THE INVENTION

Figures 1, 2, 3:
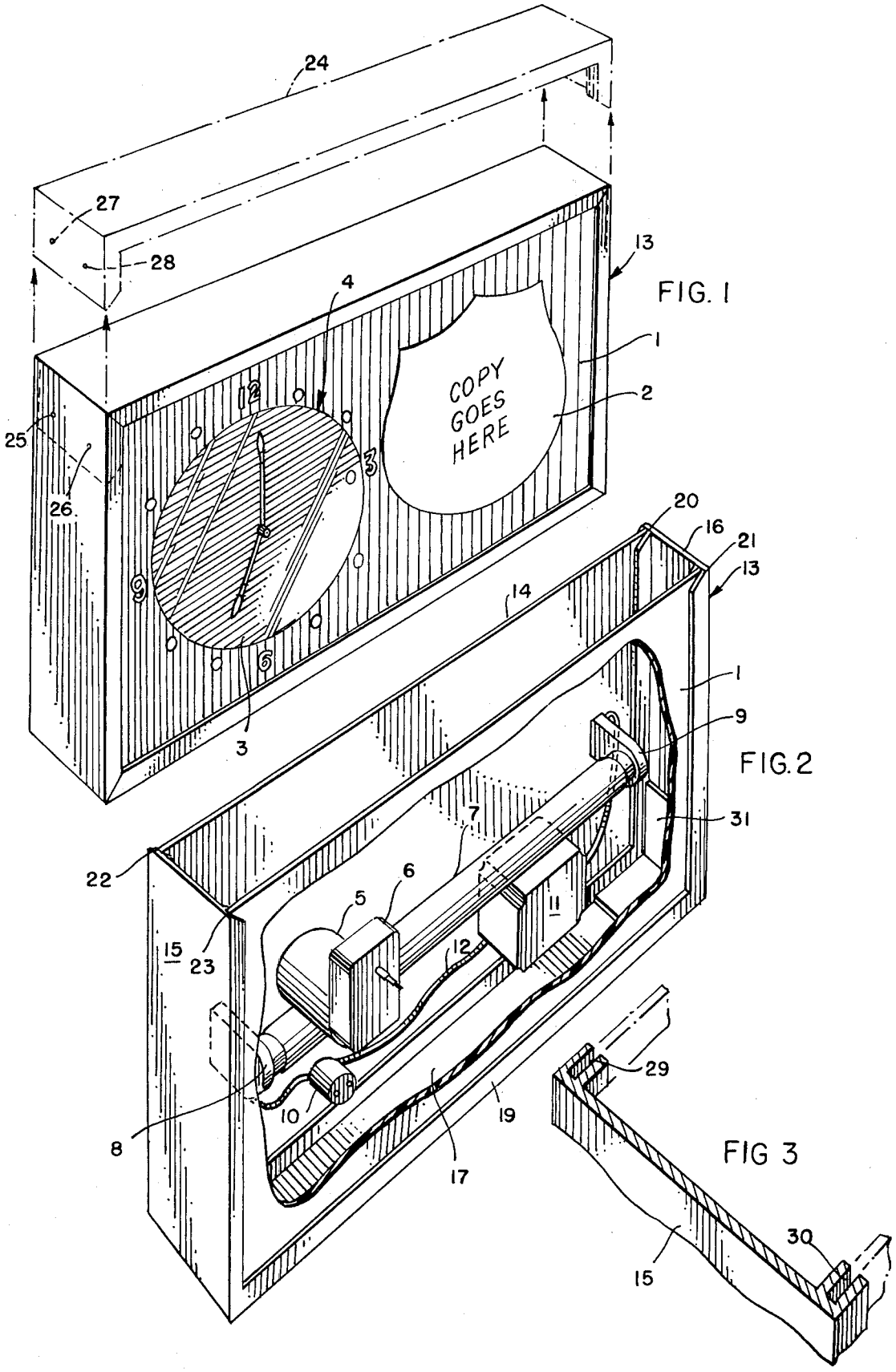
FIG. 1 is a perspective view of the front of a clock display device illustrating one embodiment of the invention.
FIG. 2 is a perspective view of the rear of a modified form of the device shown in FIG. 1 with parts broken away.
FIG. 3 is a perspective view, partly in section, of a portion of the housing of the display device shown in FIG. 2.

In accordance with the invention a display device is provided containing a transparent or translucent panel having a display on the front or back of said panel, illuminating means mounted back of said panel to cause light to be transmitted around or through said display, and a plurality of discs mounted for rotation in front of said illuminating means to the rear of said panel and to one side of said display, said discs having radial light transmitting sections and means to cause the rotation of said discs, preferably a clock mechanism, to produce a flashing radial light which moves in an orbit and at times during the course of said movement is directed toward said display.

The invention also provides a new type of clock mechanism in which indicating means for hours, minutes and seconds are illuminated in a novel manner.

DETAILED DESCRIPTION OF THE INVENTION

In the embodiment of the invention illustrated in the drawings, the display devices comprises a panel 1 having a display 2 printed on the front or back of a transparent or translucent portion of said panel, preferably by screen printing, using either opaque or light transmitting printing inks.

To one side of the printed display portion 2 is a clear or transparent portion 3 which forms a cover for a clock generally indicated at 4. Referring to FIG. 2, the clock 4 is driven by a synchronous motor 5 through a gear train generally indicated at 6 in a conventional manner.

Illuminating means are mounted back of panel 1 to cause light to be transmitted around or through the printed display area 2. In the drawing as shown by FIG. 2 the illuminating means is a fluorescent lamp 7 mounted on fixtures 8 and 9 in a conventional manner and operated through a starter 10 and a transformer 11 connected by wires 12. The lamp 7 and the synchronous motor 5 are connected together in the conventional manner in an electrical circuit which in turn is connected to the usual 115-125 volt 60 cycle alternating current source of electrical energy. It will be understood that any other source of illumination can be used as, for example, a conventional incandescent lamp.

The housing 13 consists of the front panel 1, a back panel 14, two side panels 15 and 16, a bottom panel 17, channel member 18, 19, 20, 21, 22, 23 and a removable top 24, which is adapted to fit inside the housing and be held in place by any suitable means, for example, by inserting screws into the holes 25, 26, 27 and 28. Similar fastening means can be provided on the opposite sides of the top of the housing. By removing the fastening means, the top of the housing can be removed and the front panel 1 can also be removed by pulling it upwardly so that it will slide out of the channels or grooves in members 21 and 23. It will be understood that the channels or grooves 29 and 30 as shown in detail in FIG. 3 can be integrally formed with the side walls 15 or 16. Similar channels or grooves can be provided at 18 and 19, and the bottom member 17. The sides and bottom are connected in a conventional manner by right angle brackets 31.

Figures 4, 5:
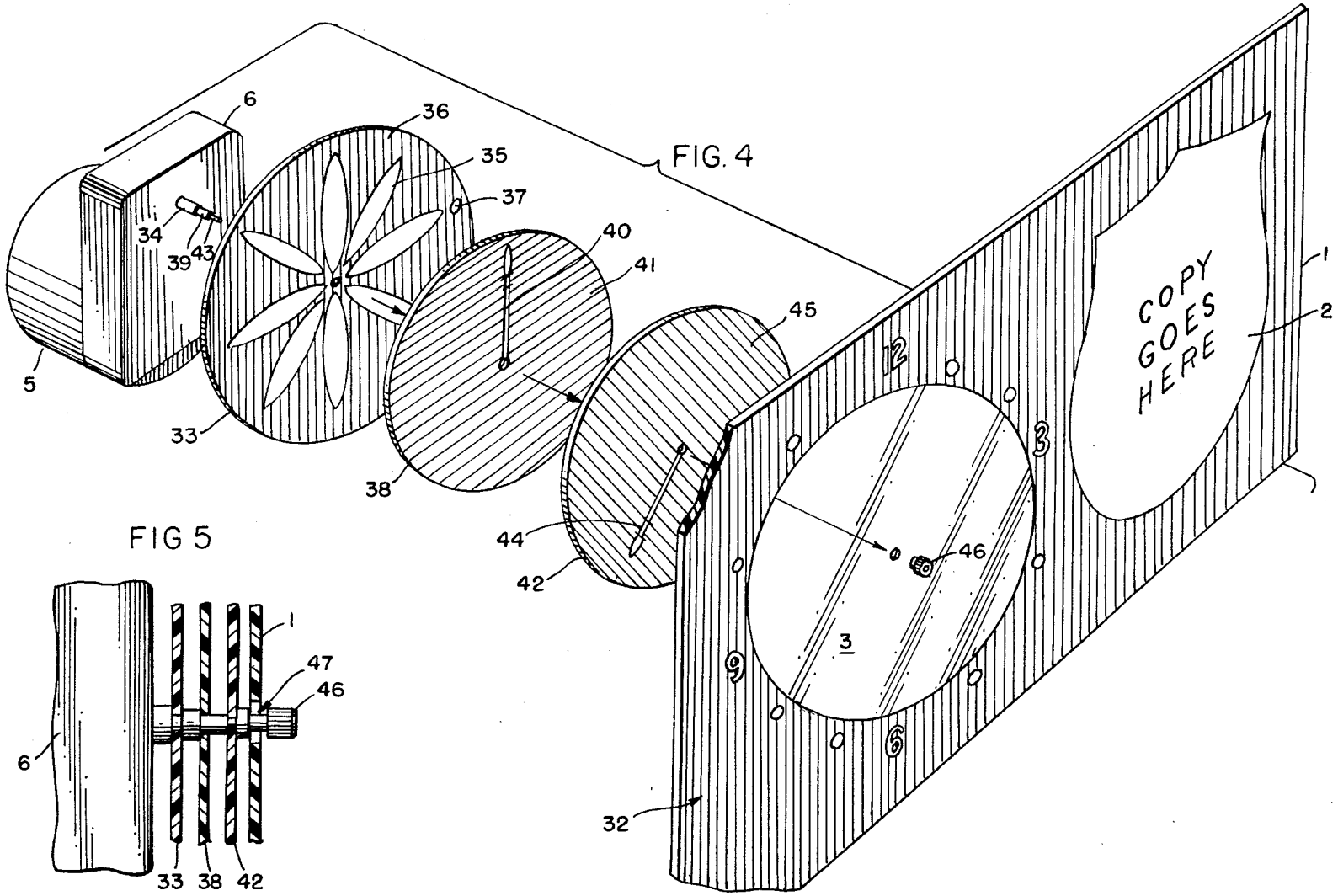
FIG. 4 is an exploded view of the essential components of a display device of the type illustrated in FIGS. 1 and 2.
FIG. 5 is a view, partly in section, of an assembly of certain of the components of the display device shown in FIG. 4.

Referring to FIG. 4 it will be seen that the synchronous motor 5 and the conventional clock gear train mechanism 6 are mounted to the rear and to one side of the panel 1 and the display area 2 directly behind the transparent area 3 of panel 1. The remaining area 32 of panel 1 is preferably opaque or possibly in some cases, translucent and contrasting in color to the printed design in area 2 and to the flashing radial lights produced behind area 3 of panel 1 by the mechanism hereinafter described.

According to a preferred embodiment of the invention a disc 33 which may also be called a pattern disc is mounted for rotation in front of the illuminating means previously described on the shaft 34 which corresponds to the operating mechanism for the second hand of an electric clock. Thus, when the motor 5 is running, disc 33 will make one complete revolution in 60 seconds. Disc 33 is made of plastic or other suitable material and has a plurality of radial light transmitting sections 35 in the general configuration of a daisy on an opaque background 36. A transparent circular area 37 which can also be a hole or an opening permits light to pass through disc 33. Instead of a hole or light transmitting opening 37, a translucent rod can be attached to the first disc which is rotatable around the outer rim of the second and third discs hereinafter described.

A second disc 38 is mounted on shaft 39 which corresponds to the hour hand shaft of a clock and is adapted to make one complete revolution in a period of 12 hours. Disc 38 is made of plastic or other suitable material and has a radial light transmitting section 40 which can be in the form of a transparent area in disc 38 or a radial slot in disc 38 with a colored background in the area 41 which may be, for example, red.

A third disc 42 is mounted for rotation on the minute hand shaft 43 and is adapted to make one complete revolution in a period of one hour. Disc 42 is similar to disc 38 in that it has a radial light transmitting area 44 which can also be in the form of a slot and a colored background area 45 which is normally a different color from the color of background area 41 on disc 38. For example, when the background area 41 is red, the color of the background area 45 might be blue or green.

The discs are aligned so that light from the illuminating means will pass through their light transmitting sections and the combination of the colors in the second and third discs is preferably such, or the discs are sufficiently thick, so as to block light everywhere except at locations aligned with one of the radial transparent sections or slots in the second or third discs, so that whenever a transparent section or slot in the second or third discs is aligned with a transparent section on the first disc a colored illuminated radially moving flashing hour or minute hand is presented to the viewer.

The discs 38 and 42 are normally of the same size and the disc 33 normally has a greater diameter so that the hole or transparent dot 37 which acts as a "seconds" indicator moves in an orbital path around the outside of discs 38 and 42 and can be viewed from the front of panel 1.

As shown by the assembly of the discs in FIG. 5 a knob 46 which extends through an opening 47 in panel 1 can be used to set the positions of the discs 33, 38 and 42 in the same manner as in the setting of the hands of a clock. The knob 46 can be made removable and the panel 1 can be made of any suitable flexible plastic material so that when it is assembled by sliding it in the channel members shown in FIGS. 1 and 2 it can be bowed outwardly to permit the opening 47 to pass over knob 46 and thereafter to allow the sides of panel 1.

The rotation of the discs 33, 38 and 42 at variable speeds with respect to one another produces a flashing radial light which moves in an orbit and at times during the course of said movement is directed toward the display area 2, thereby attracting the attention of the viewer. At the same time the mechanism which produces the orbital flashing radial light also has the dual function of serving as a clock and therefore provides a new type of clock mechanism in which indicating means for hours, minutes and seconds are illuminated in a novel manner.

It will be recognized that the use of a plurality of discs mounted for rotation in front of the illuminating means to the rear of the panel and to one side of the display, said discs having radial light transmitting sections and means to cause the rotation of said discs to produce a flashing radial light moving in an orbital path, does not necessarily have to use a clock driving mechanism to provide relative movement between said discs. Furthermore, while it is necessary to have a plurality of discs, it is not always essential to have three discs because a flashing orbital radially moving light can be achieved with two or more discs. In addition, it should be understood that the discs do not have to be driven by concentrically arranged shafts 34, 39 and 43 as in the embodiment used for illustration but can be driven by any other suitable means, for example, driving means mounted at or adjacent the outer peripheries of the discs. It will also be understood that the arrangement of the discs may be changed.

The invention is hereby claimed as follows:

1. A display device comprising:

A panel having a display area and a display at said display area;

said panel being mounted in a housing containing channels to hold the sides of said panel in sliding relationship so as to permit the removal of said panel and its replacement by another display panel without otherwise affecting the display device and said panel being slightly flexible permitting it to be bowed outwardly in mounting it and removing it from said housing;

illuminating means mounted back of said panel to cause light to be transmitted through said display area; and a plurality of discs mounted for rotation in front of said illuminating means to the rear of said panel and one side of said display, said discs having radial light transmitting sections and being aligned so that light from said illuminating means passes through said light transmitting sections, and means to cause the rotation of said discs to produce a flashing orbital radial light.

2. A display device comprising:

A panel having a display area and a display at said display area;

illuminating means mounted back of said panel to cause light to be transmitted through said display area; and a clock adjacent said display area comprising a clock driving mechanism, a first pattern disc rotatable in response to said mechanism including radial transparent sections on an opaque background, a second disc rotatable in response to said mechanism at the rate of one revolution every twelve hours and having a radial transparent section and otherwise being colored with the colored portion being light transmitting, and a third disc rotatable in response to said mechanism at the rate of one revolution every hour and having the same characteristics as the second disc except that it is a different color, said first, second and third discs being aligned so that light from said illuminating means passes through said first, second, and third discs in the order named, the second and third discs blocking light everywhere except at locations aligned with one of the transparent sections in the second or third discs so that whenever a transparent section on the second or third disc is aligned with a transparent section on the first disc a colored radially moving flashing illuminated hour and minute hand is presented to the viewer.

3. A display device as claimed in claim 2 wherein said transparent sections in said second and third discs are slots.

4. A display device as claimed in claim 2 wherein the second disc is colored red and the third disc is colored blue and the discs are sufficiently light transmitting to permit the passage of red and blue light, respectively, when aligned with a transparent section on the first disc.

5. A display device as claimed in claim 2 wherein said panel containing said display has the display printed thereon.

6. A display device as claimed in claim 2 wherein said panel containing said display is mounted in a housing containing channels to hold the sides of said panel in sliding relationship so as to permit the removal of said panel and its replacement by another display panel without otherwise affecting the display device.

7. A display device as claimed in claim 6 wherein said panel is slightly flexible permitting it to be bowed outwardly in mounting it and removing it from said housing.

8. A display device as claimed in claim 6 wherein said housing has a removable top which upon removal permits access and removal and replacement of said panel containing said display.

* * * * *

UNITED STATES PATENT OFFICE

CERTIFICATE OF CORRECTION

Patent No. 3,992,872 Dated November 23, 1976

Inventor(s) Robert B. Stanish

It is certified that error appears in the above-identified patent and that said Letters Patent are hereby corrected as shown below:

Column 4, line 14 - after "panel 1" insert

--to snap into place in the channels in members 21 and 23. In this way it is possible to insert different panels 1 with different display areas 2.--

Column 4, line 44 - insert

--This would require some alteration in the setting mechanism previously described as used in a conventional clock mechanism. Of course, the driving means for the discs can be mechanical (e.g., wound spring type) or electrical or any other type of driving mechanism.--

Signed and Sealed this

Nineteenth Day of April 1977

[SEAL]

*Attest:*

RUTH C. MASON
*Attesting Officer*

C. MARSHALL DANN
*Commissioner of Patents and Trademarks*